US006748713B2

(12) United States Patent
See

(10) Patent No.: US 6,748,713 B2
(45) Date of Patent: Jun. 15, 2004

(54) SUSPENDED CEILING CONSTRUCTION

(76) Inventor: Tosser J. See, 552 S. Bayberry, Corpus Christi, TX (US) 78418

( * ) Notice: Subject to any disclaimer, the term of this patent is extended or adjusted under 35 U.S.C. 154(b) by 0 days.

(21) Appl. No.: 10/263,263

(22) Filed: Oct. 2, 2002

(65) Prior Publication Data

US 2004/0065037 A1 Apr. 8, 2004

(51) Int. Cl.[7] ..... E04B 2/00; E04B 5/00; E04B 9/00

(52) U.S. Cl. ..... 52/506.07; 52/506.06; 52/664; 52/22; 52/665

(58) Field of Search ..... 52/506.07, 506.06, 52/22, 664, 665

(56) References Cited

U.S. PATENT DOCUMENTS

| | | | | | |
|---|---|---|---|---|---|
| 3,119,475 | A | | 1/1964 | Adams | |
| 3,275,817 | A | | 9/1966 | Schwartz | |
| 3,286,427 | A | | 11/1966 | Cotter | |
| 3,343,310 | A | * | 9/1967 | Netz et al. | 52/28 |
| 3,372,270 | A | * | 3/1968 | Quin et al. | 362/150 |
| 3,581,448 | A | * | 6/1971 | Roux | 52/28 |
| 3,591,794 | A | * | 7/1971 | Dail et al. | 362/150 |
| 3,668,826 | A | * | 6/1972 | White et al. | 52/28 |
| 4,004,390 | A | | 1/1977 | Merkwitz | |
| 4,055,930 | A | | 11/1977 | Weinar | |
| 4,115,970 | A | | 9/1978 | Weinar | |
| 4,438,613 | A | | 3/1984 | Hintsa | |
| 4,827,687 | A | | 5/1989 | Frawley | |
| 5,177,923 | A | | 1/1993 | Nemchock | |
| 5,609,007 | A | * | 3/1997 | Eichner | 52/747.1 |
| 5,647,182 | A | | 7/1997 | Rutherford | |
| 5,664,384 | A | * | 9/1997 | Cullinan | 52/507 |
| 6,047,512 | A | * | 4/2000 | Wendt et al. | 52/506.07 |

* cited by examiner

*Primary Examiner*—Carl D. Friedman
*Assistant Examiner*—Nahid Amiri

(57) ABSTRACT

A suspended ceiling provides horizontal areas of different elevation and a transitional area between the horizontal areas. The ceiling comprises a grid of horizontal intersecting supports and panels received by the supports. The transitional area is constructed by inclined supports connected to the horizontal supports by clips of special design. In a situation where three supports converge, a clip is provided having three channels diverging at appropriate angles. In a situation where four supports converge, a clip is provided having four channels diverging at appropriate angles. The clips include tabs which are crimped over the horizontal supports and the inclined supports of the transition area. The clips are of metal and of sufficiently thin gauge so they can be bent to provide the angles necessary in the transition area. An important feature of the invention is the ability to make modules comprising the grid for transition areas on a jig in a shop and transport it to a job site for installation.

8 Claims, 4 Drawing Sheets

SUSPENDED CEILING CONSTRUCTION

This invention is directed to a suspended ceiling construction and more particularly to a suspended ceiling construction having inclined transitional zones between areas of different elevation.

BACKGROUND OF THE INVENTION

Suspended ceilings are commonly used in office buildings, schools and other large buildings and comprise a supporting grid of horizontal intersecting supports which receive panels typically called acoustic panels. Ceilings of this type became popular because of a combination of low cost, desirable acoustic damping properties, ease of installation, an ability to accommodate and hide overhead air conditioning ducts, electrical wiring and plumbing conduits, and providing a plenum for return air. Although early suspended ceilings were flat, it did not take long for the industry to provide more complex shapes, typically having recesses providing improved acoustic damping properties, improved eye appeal and elevated lighting fixtures.

Disclosures relevant to the disclosure of this invention are found in U.S. Pat. Nos. 3,119,475; 3,275,817; 3,286,427; 4,004,390; 4,055,930; 4,115,970; 4,438,613; 4,827,687; 5,177,923 and 5,647,182.

SUMMARY OF THE INVENTION

A problem has always existed in providing transitional areas between areas of different elevation in suspended ceilings. The transitional areas are typically made by workmen at the site. The result is that the quality of construction and its eye appeal depend on the ability of the person at the job site. Thus, the results are normally unpredictable—some jobs look fine and others looked awkward.

Architects and designers are not currently able to achieve the same standard quality for the look and performance on different projects based on the ability of craftsmen and their methods of handling irregularities and transitions. In addition, architects and designers cannot produce custom designs using commodity materials without incurring significant labor costs and the risk of poorly executed plans. This invention allows irregularities that occur on a project to be handled in a uniform manner and thereby give architects and designers the options to use a standard ceiling construction method in handling irregularities and elevation changes.

A transition zone is provided between different levels of planar ceiling sections. The gridwork for the planar ceiling sections comprises conventional intersecting T-bars suspended by wires from an overlying support. In this invention, the connections between the inclined gridwork of the transition zone and the planar ceiling sections is done by connectors or clips that are crimped onto the T-bar supports or which are supported by the T-bar supports.

The shape of the connectors or clips at any particular location depends on how many T-bar supports intersect at the junction of the planar ceiling section and the transition zone. For example, where an inclined T-bar support of the transition zone intersects a mid-point of a horizontal T-bar, the clip comprises a pair of aligned channels crimped onto the horizontal T-bar support and a single perpendicular channel crimped onto the inclined T-bar support. The exact shape of the clips accordingly depends on the situation at the junction between the transition and horizontal T-bar supports. A surprisingly few clips can accommodate almost any practical situation. This is largely true because the angles required between the transition gridwork and horizontal gridwork is accommodated simply by bending the clip to the desired angle.

This invention also allows economies in the construction of transition zones between ceiling sections of different elevation. In the past, all transition zones were fabricated on the job site. In this invention, the gridwork of repeated custom ceiling configurations, such as pyramidal sections, are fabricated in a shop on a jig, transported to the job site and simply dropped in place, crimping the connectors onto the T-bar supports as needed.

It is an object of this invention to provide an improved ceiling construction.

Another object of this invention is to provide new methods and techniques for creating different ceiling layouts and designed using industry standard grid systems to provide improved suspended ceiling construction assemblies.

A more specific object of this invention is to provide an improved ceiling construction in which transitional areas between planar ceilings of different elevation are handled in an easy manner providing uniform results.

Another object of this invention is to provide improved transitional areas for suspended ceilings.

A further object of this invention is to provide manufactured assemblies for installation in new or existing acoustical ceiling systems.

These and other objects and advantages of this invention will become more apparent as this description proceeds, reference being made to the accompanying drawings and appended claims.

DETAILED DESCRIPTION

Figure 1:
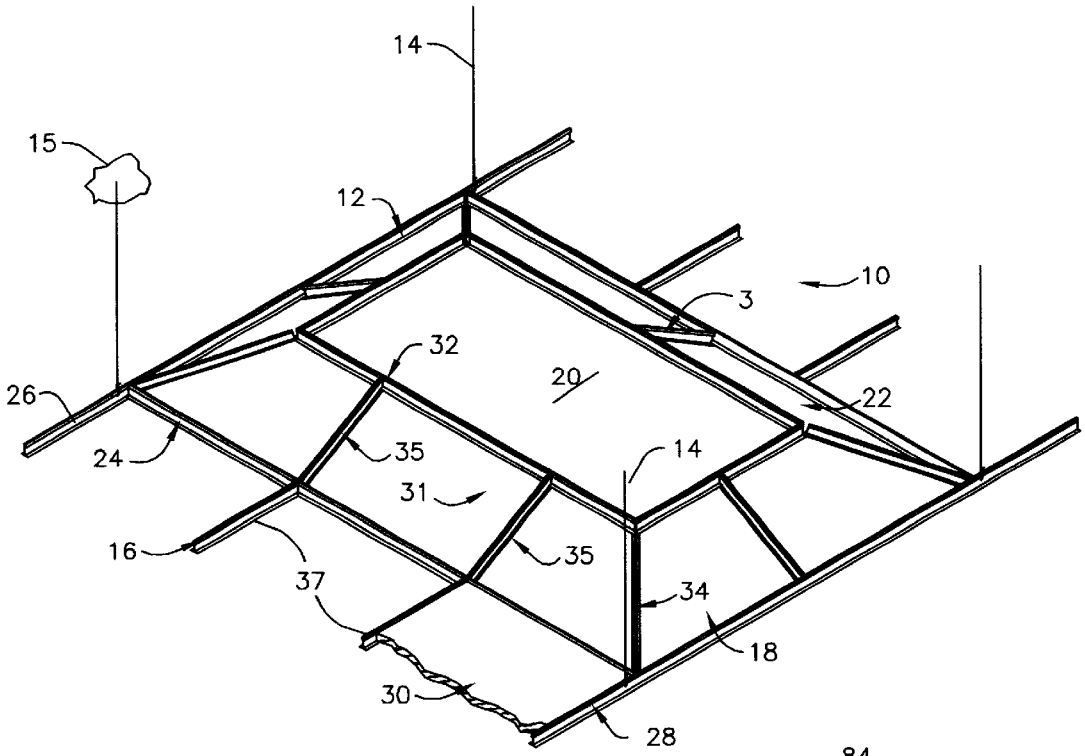
FIG. 1 is an isometric view of part of a suspended ceiling, viewed from above, illustrating a ceiling recess of common shape.

Referring to FIG. 1, a suspended ceiling 10 comprises a grid 12 suspended by wires, straps or other tensile supports 14 from an overlying support 15 which is typically the underside of a poured concrete floor of the next story of a multistory building, roof joists in a single story building or the like. The ceiling 10 includes a horizontal flat area 16 and one or more recesses 18 providing improved acoustic damping, improved eye appeal, a position for an elevated lighting fixture or the like.

The recess 18 provides an elevated horizontal area 20 connected by an annular transition area 22. Although the recess 18 may be of any suitable size and shape, it is illustrated as being of a typical size and typical proportion. The horizontal area 20 is shown to be 2'×4' which is also the dimension of the top of the transition area 22. The base of the transition area 22 is shown to be 4'×6' and the vertical separation between the horizontal areas 16, 20 is shown to be 7". It is evident that all these dimensions manifestly may vary.

The grid 12 comprises a series of horizontal intersecting supports 24. Although the supports 24 may be of any suitable type, they are illustrated as conventional T-bar supports having a vertical leg 26 and a horizontal cross-bar 28. The supports 24 are connected together at their horizontal intersections in a conventional manner to provide a lightweight, surprisingly sturdy grid for receiving horizontal panels 30 thereby providing the horizontal ceiling area 16.

The elevated horizontal area 20 and the transition area 22 provide a support structure 31 made of a plurality of horizontal intersecting supports 32 substantially identical to the supports 24 in the sense of being conventional T-bar supports. The structure 31 is illustrated to provide three types of inclined supports 33, 34, 35. The supports 33 extend perpendicularly to the horizontal supports 24, 32 and terminate at the support 24. The supports 34 extend along the corners of the recess 18 which is may be thought of as a truncated pyramid having a square or rectangular bottom and which provide a support for an inclined flat panel. The supports 35 extend perpendicularly to the supports 24, 32 and comprise an upwardly angled extension of supports 37.

Figure 2:
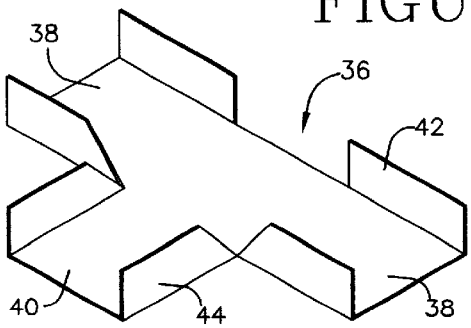
FIG. 2 is an isometric view of a clip used in the construction of the grid of FIG. 1.

The supports 33 connect to a mid-point of the supports 24, 32 by the use of connectors or clips 36. As shown in FIG. 2, the clips 36 provide a pair of aligned channels 38 for receiving the horizontal cross-bar of the supports 24, 32 and a third channel 40 perpendicular to the channels 38. The channels 38, 40 are sufficiently wide to receive the cross-bar 28 of the supports 24, 32 and thus are the same width as the cross-bars 28 and are conveniently 1" long. The cross-bars 28 are referred to in the industry as being of 1" width, which is a nominal dimension because the exact dimension is 15/16". Each channel 38, 40 is bounded by tabs 42, 44 which are crimped over the horizontal cross-bar of the supports 32, 33 and thereby secure the clip 36 and the support 33 to the support 32. The tabs 42, 44 are of any convenient size and typically are 3/8" tall. It will be seen from FIG. 1 that there is one clip 36 at the top and one clip 36 at the bottom of each inclined support 33.

The inclined supports 34 connect to the horizontal supports 24 by clips 46, 48. The inclined supports 34 create a particular problem because of the angle between the supports 34 and the upper and lower horizontal supports 32, 24. The clip 46 secures the upper end of the inclined support 34 to the horizontal support 32 at one of the corners. The clip 46 comprises a pair of channels 50 diverging at a right angle 52 and a third channel 54 diverging midway between the channels 50, i.e. at an angle 54 of 135°. The channels 50, 54 are sufficiently wide to receive the cross-bar of the supports 24 and thus are nominally 1" across and conveniently 1" long. Each channel 50, 54 is bounded by tabs 58, 60 which are crimped over the horizontal cross-bar of the supports 32, 34 and thereby secure the clip 46 and the support 34 to the upper supports 32. The tabs 58, 60 are of any convenient size and typically are 3/8" tall.

Figure 4:
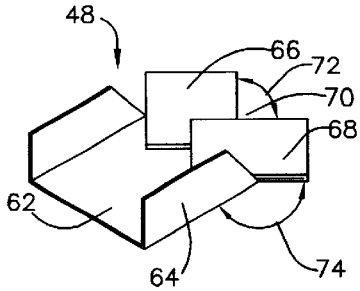
FIG. 4 is an isometric view of another clip used in the construction of the grid of FIG. 1.
Figure 3:
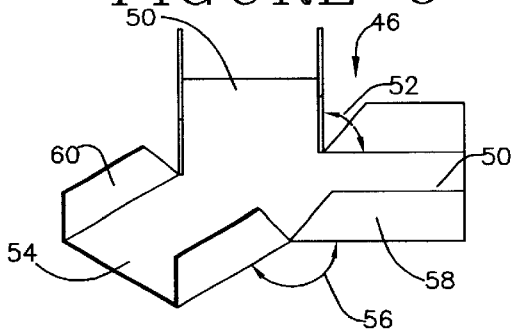
FIG. 3 is an isometric view of another clip used in the construction of the grid of FIG. 1.
Figure 5:
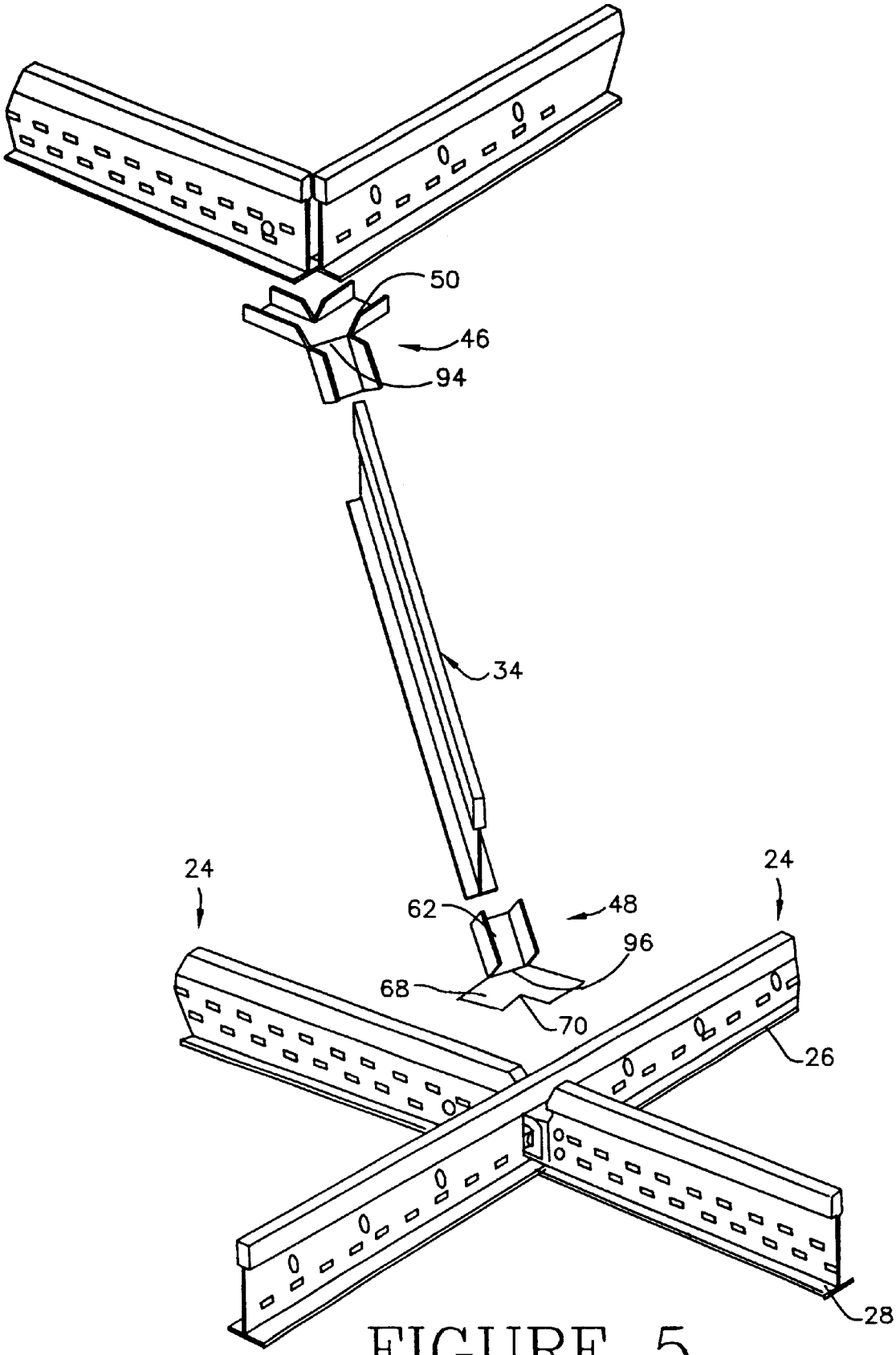
FIG. 5 is an isometric view of a typical inclined support used in the inclined transition area.

As shown best in FIGS. 4 and 5, the clip 48 is secured to the lower end of the inclined support 34 and abuts but is not connected to the lower horizontal supports 24 at one of the intersection. More specifically, the clip 48 is designed to transfer part or all of the load of the transition area 22 and the horizontal area 20 to the lower horizontal supports 24 without making a rigid connection between the inclined support 34 and the lower horizontal supports 24.

To this end, the clip 48 comprises a single channel 62 sized to receive the cross-bar at the lower end of the support 34 and provides tabs 64 for crimping the clip 48 to the support 34. The opposite end of the clip 48 provides a pair of long tabs 66 each of which is folded back on itself to provide a folded edge 68 and a notch 70 for abutting the T-bar support 24 as will be explained more fully hereinafter. The angle 72 provided by the notch 70 is preferably 90°. The channel 62 resides midway between the tabs 66 so the angle 74 between the channel 62 and the tabs 66 is 135°.

As shown best in FIG. 5, the support 34 is not rigidly connected to the supports 24. Instead, the clip 48 is attached to the support 34 and the folded edges 68 of the tabs 66 simply rest in the corner provided by the intersecting horizontal supports 24. The importance of the notch 70 should now be apparent. If the clip 48 provided an outwardly protruding point instead of the notch 70, the point would interfere with the components of the T-bars 24 at their junction. Instead, the notch 70 is recessed so there is no interference between the clip 48 and components of the supports 24 that are at the intersection. In addition, the ends of the overlapping tabs 68 are perpendicular to the vertical legs of the support 34 thereby providing a positive stop.

Figure 6:
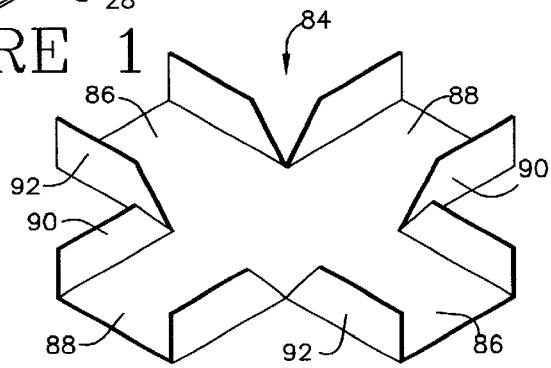
FIG. 6 is an isometric view of another clip used in the construction of the grid of FIG. 1.

Referring to FIGS. 1 and 6, the supports 35 connect to a the supports 24, 32 by the use of clips 84 at a location where an additional horizontal support 37 is located in the flat ceiling area 16. As shown in FIG. 6, the clips 84 provide a pair of aligned channels 86 for receiving the horizontal cross-bar of the support 24 and a pair of aligned channels 88 perpendicular to the channels 86. The channels 86, 88 are sufficiently wide to receive the cross-bars 28 of the supports 24, 35, 37 and thus are typically 1" across and conveniently 1" long. Each channel 86, 88 is bounded by tabs 90, 92 which are crimped over the horizontal cross-bar 28 of the supports 24, 35, 37 and thereby secure the clip 48 and the support 35 to the supports 24, 37. The tabs 90, 92 are of any convenient size and typically are 3/8" tall. It will be seen from FIG. 1 that there is one clip 36 at the top and one clip 84 at the bottom of each inclined support 35.

An important feature of the clips 36, 46, 48, 84 is that they are made of a thin metal, e.g. 30 to 26 gauge, so they may be bent to accommodate any practical angle between the upper supports 32 and the lower supports 24. For example, in FIG. 5, the clip 46 is bent along a line 94 and the clip 48 is bent along a line 96 to accommodate the angle between the upper and lower horizontal ceiling areas 16, 20. This means that any rectangular or square truncated pyramidal recess can be constructed using only conventional T-bar supports and either the three clips 36, 46, 48 or including the fourth clip 84 because the clips can be bent to accommodate any practical angle between the upper supports 32 and the lower supports 24.

It will accordingly be seen that the horizontal supports 24 support the horizontal area 20 and the transition area 22 because there are no wires or other means supporting the horizontal supports 32 or the clips 36, 46, 48 from the overlying support. It will also be seen that the horizontal area 20 receives a ceiling panel which may be of an acoustic type, a lighting fixture, a decorative panel or the like. It will be seen that the grid 12 of the ceiling 10 is supported by a lower set of horizontal supports acting through the tensile members 14 from an overlying member and an upper set of horizontal supports, comprising the periphery of the area 20, is supported only through the lower set of horizontal supports.

Installation of the ceiling 10 should now be apparent. At the job site, the horizontal supports 24 are suspended from the overlying support 15, leveled, and connected together at their intersections in a conventional manner. On a jig in the shop, a module comprising the grid 31 is prepared by attaching the supports 32 together and securing the inclined supports 33, 34 to the supports 32. The module is transported to the job site and each grid 31 is dropped into the opening which comprises the recess 18. The lower ends of the inclined supports 33 are attached to the horizontal supports 24 and the lower ends of the inclined supports 34 simply rest on the supports 24 at their intersection. As used herein, the phrase "job site" is used to mean the building where the ceiling of the invention is being installed. The word "shop" is used to mean a location of the contractor rather than the building owner, typically at the place of business of the contractor, and distant from the job site.

A great many installations may be constructed with a relatively few clips in accordance with this invention. For example, the ceiling 10 is made with four different clips as shown in FIGS. 2–4 and 6.

Referring to FIGS. 7–10, there is illustrated a ceiling 100 featuring a series of downwardly extending truncated pyramidal projections 102, rather than upwardly extending pyramidal recesses shown in FIG. 1. In the ceiling 100, a gridwork 104 comprises a series of intersecting T-bar supports 106 suspended from an overhead support 107 by wires 108. The pyramidal projections 102 accordingly each provide a flat area 110 bounded by T-bar supports 112 and a transition area 114 or 116.

The transition areas 114, 116 are illustrated to be slightly different for purposes of illustration. The transition area 114 comprises a series of inclined T-bar supports 118 intersecting a mid-point of the T-bar supports 112, 106 in a simple three way junction which can be constructed by use of the clip 36 shown in FIG. 2. Both transition areas 114, 116 provide inclined T-bar supports 120 intersecting the supports 112 at the corners of the flat areas 110. These junctions can be constructed using the three way clip 46 of FIG. 3 in the manner shown in the single pyramid of FIG. 1.

At the intersection 122, which is characterized by a continuous support 106 along one edge of the intersection, a connector or clip 124 (FIG. 8) secures the supports 106, 120 together. The clip 124 comprises a pair of aligned channels 126 for receiving the continuous support 106 and three channels 128, 130, 132 spaced equidistantly between the channels 126. Tabs 134 are provided adjacent each of the channels 126, 128, 130, 132 for securing the clip 124 to the supports 106, 120. The channels 128, 132 may be bent along imaginary lines 136, 138 to accommodate the angle that the inclined support 120 makes with the horizontal.

At the intersection 140 where eight supports come together, the clip 142 (FIG. 9) is provided, having eight equidistantly spaced channels 144. Those channels 144 that receive the horizontal supports 106 remain in the plane of the clip 142 and those channels 144 which receive the inclined supports 120 may be bent along imaginary lines 146 to accommodate the angle. One or more tabs 148 adjacent each channel are crimped onto the horizontal rib of the T-bar supports 106, 120.

At the intersections 150 where three supports come together, the clip 46 (FIG. 3) is used to connect the horizontal and inclined supports together. At the intersections 152 where three supports come together, the clip 36 (FIG. 2) is used to connect the horizontal and inclined supports together.

In the event the supports 106 were to intersect in a corner of the building, a clip 154 (FIG. 10) is provided. The clip 154 provides channels 156 for receiving the horizontal supports 106 and a channel 158 equidistant between the channels 156 for receiving an inclined support 106.

Figure 7:
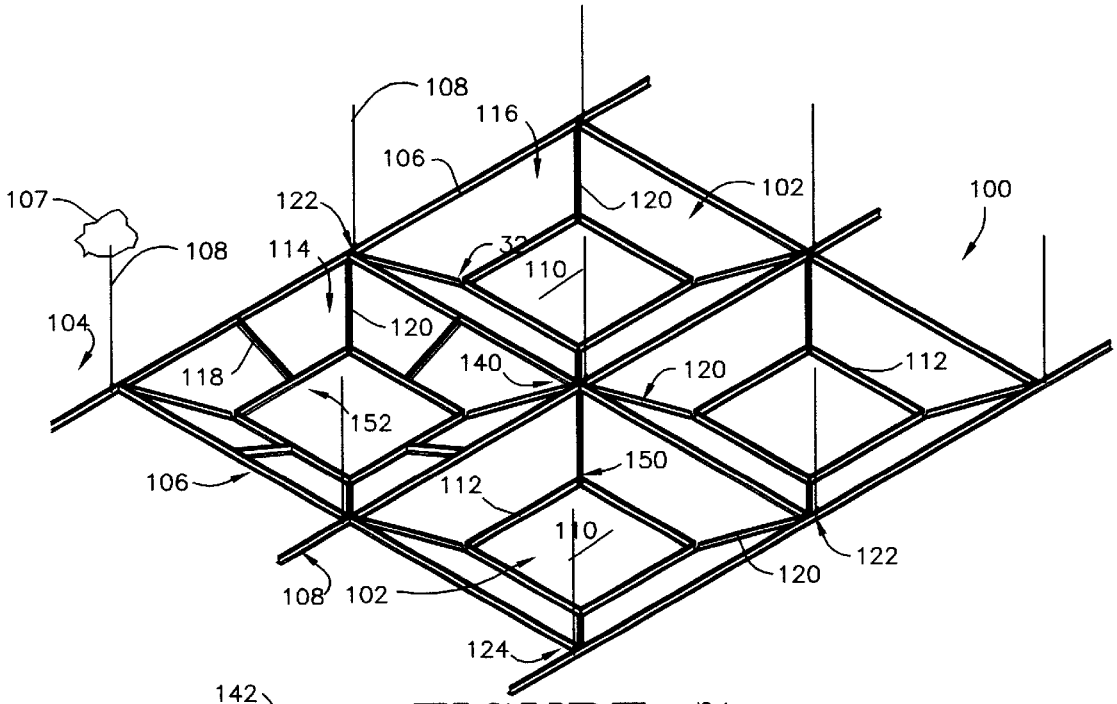
FIG. 7 is an isometric view of part of a suspended ceiling, viewed from above, illustrating an unusual ceiling construction.
Figure 9:
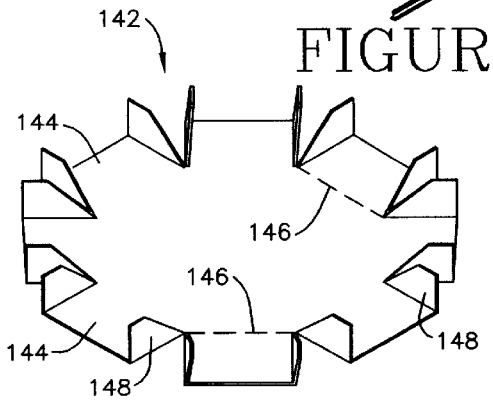
FIGS. 8–10 are isometric view of additional clips needed to construct the ceiling of FIG. 7.
Figure 8:
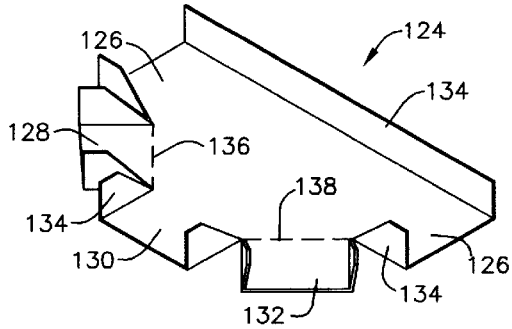
Figure 10:
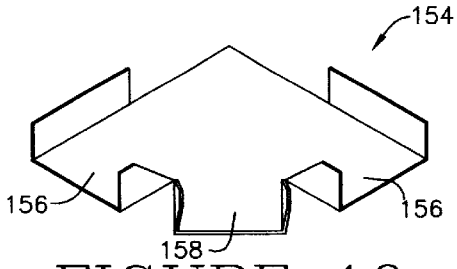

It will accordingly be seen that the supports 106, 120 provide recesses for receiving suitable ceiling panels. It will likewise be seen that the ceiling of FIG. 7 is supported from a upper set of horizontal supports 106 while a lower set of horizontal supports, comprising the periphery of the areas 110, are unsupported from an overlying member or beam except through the upper supports 106. The ceiling 100 of FIG. 7 shows two different designs, i.e. the inverted pyramid at the far left is different than the other three inverted pyramids. A ceiling made in the design shown at the far left requires five different clips, i.e. the clips of FIGS. 8–10 plus the clip 36 of FIG. 2 and the clip 46 of FIG. 3. A ceiling made in the design shown in the other three inverted pyramids requires only four different clips, i.e. the clips of FIGS. 8–10 plus the clip 46 of FIG. 3.

Figure 11:
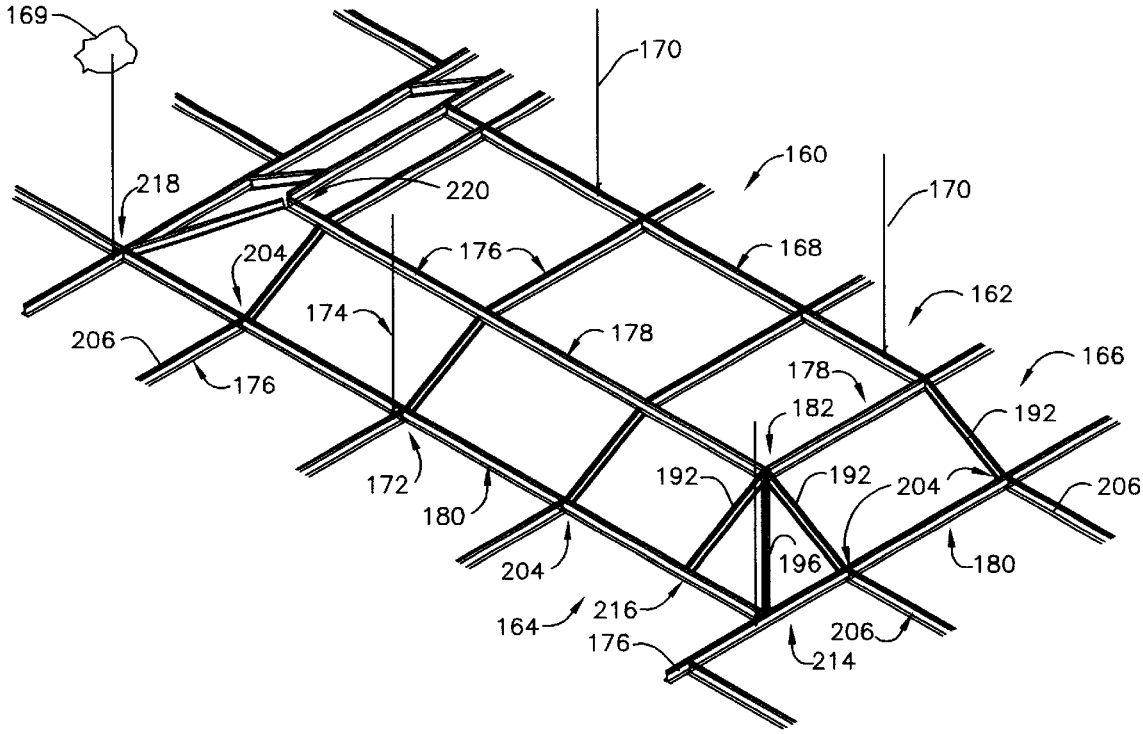
FIG. 11 is an isometric view of part of a suspended ceiling, viewed from above, illustrating a typical transition area dictated by the shape of the area in which the ceiling is located.

Referring to FIG. 11, a suspended ceiling 160 of different configuration is illustrated. The ceiling 160 shows a typical example of a ceiling where the elevation of the ceiling is changed for any number of reasons and comprises an upper ceiling area 162, a lower ceiling area 164 and a transition zone 166 between the areas 162, 164. The ceiling area 162 comprises a grid of suitable intersecting horizontal supports, such as conventional T-bar supports 168 suspended from an overlying member 169 by wires or straps 170. Similarly, the ceiling area 164 comprises a grid of suitable intersecting horizontal supports 172 suspended from an overlying member by wires or straps 174. It will be seen that the periphery of the ceiling area 162 is bounded by continuous supports 178 while the periphery of the lower ceiling area 162 is bounded by continuous supports 180. The supports 178, 180 may be made continuous, of course, by securing pieces end to end.

Figure 12:
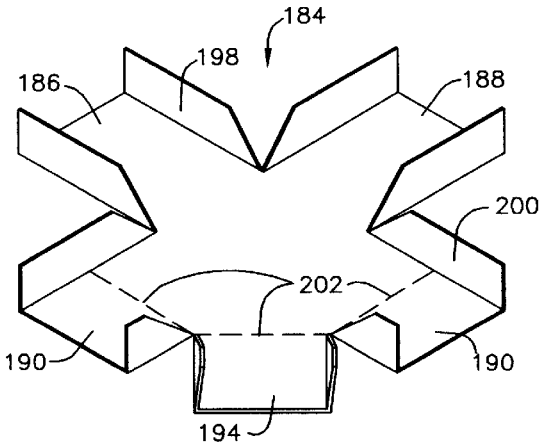
FIG. 12 is an isometric view of an additional clip used to construct the ceiling of FIG. 11.

At the intersection 182, a clip or connector 184 (FIG. 12) is provided to secure the supports together and accordingly provides a pair of channels 186, 188 for receiving the supports 178, a pair of channels 190 for receiving inclined supports 192 and a channel 194 for receiving a diagonal support 196. One or more tabs 198 adjacent each channel 186, 188, 190, 192 are provided for crimping the channels to the supports. Because of the inclination of the supports 192, 196, the channels 190, 192 may be bent along imaginary lines 202 to accommodate the angle.

At the intersection 204, the four way clip 84 (FIG. 6) may be used to connect the continuous supports 178, 180 to the inclined supports 192. Because the upper and lower ceiling areas 160, 162 are both supported by the wires 170, 174, there is little force transferred through the transition area 166 except for the weight of the ceiling panels in the transition area. In such circumstances, the upper end of the diagonal support 196 may be provided with a clip 48 (FIG. 4) which simply rests on the flattened face of the clip 84.

It will be seen that the intersection 214 is similar to the intersection at the bottom of FIG. 5 except it is a four way junction rather than a five way junction. Accordingly, the bottom of the diagonal support 196 may be provided with the clip 48 (FIG. 4) and simply abut the intersection of the supports 180 which requires the three way junction clip 36 of FIG. 2.

The intersection 216 will be seen to be identical to other three way intersections. The horizontal supports 178 may accordingly be secured to the inclined supports 192 by the three way clips 36 shown in FIG. 2. The intersection 218 will be seen to be identical to the bottom of FIG. 5 and may be handled similarly.

The intersection 220 is a three way corner with the diagonal support making a 135° angle with each of the supports 178. Accordingly, the three way connector 46 (FIG. 3) may be used.

The ceiling 160 of FIG. 11 shows two different designs, i.e. on the lower right, the downwardly inclined supports 192 align with the horizontal supports 206 while on the upper left, the downwardly inclined supports do not align with the horizontal supports. A ceiling made in the design shown at the lower right requires only four different clips: a five way junction clip 184 for each intersection 182, a three way junction clip 36 and clip 48 for each intersection 214, and either a four way junction clip 84 or a two way junction clip 208 for each four way junction. A ceiling made in the design shown at the upper left requires only a few clips: a three way junction clip 46 for each intersection 220, a four way junction clip 84 and a clip 48 for each intersection 218, and either a four way junction clip 84 or a two way junction clip 208 for each four way junction.

It will accordingly be seen that many different suspended ceiling configurations may be assembled from suitable supports and a modest number of clips of this invention.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A ceiling grid structure comprising a lower set of intersecting horizontal panel first supports for receiving ceiling panels and thereby providing a first ceiling area at a first elevation;

an upper set of intersecting horizontal panel second supports for receiving ceiling panels and thereby providing a second ceiling area at a second elevation higher than the first elevation;

at least one of the sets being suspended from an overlying member; and a transition zone between the upper and lower sets of horizontal panel supports comprising a series of panel third supports inclined between the upper and lower sets of intersecting horizontal panel supports for receiving inclined ceiling panels;

first connectors securing upper ends of the third supports to the upper horizontal panel supports, the first connectors comprising clips having at least a first channel receiving the first support and a tab adjacent the first channel crimped onto the first support and thereby attaching the first support to the clips for supporting the third support from the first support and a second channel receiving the third support and at least one tab adjacent the second channel crimped onto the third support and thereby attaching the third support to the clip, the first connectors being free of connection to the overlying member except through the supports; and second connectors on lower ends of the third supports supporting the third supports on the lower horizontal panel supports, the second connectors comprising clips having a third channel and at least one tab adjacent the third channel crimped onto the third support, the second connectors being free of connection to the overlying member except through the supports, the third supports being inclined at a predetermined angle to the horizontal and the first and second connectors are bent to accommodate the angle.

2. The combination of claim 1 wherein the upper set of horizontal panel second supports are suspended from an overlying member.

3. The combination of claim 1 wherein the first connector further comprises a third channel receiving the first support and a tab adjacent the third channel crimped onto the first support.

4. The combination of claim 1 wherein the lower set of supports comprises an intersection and at least one of the third supports abuts the intersection in load supporting relation.

5. The combination of claim 4, wherein the lower set of supports is suspended from the overlying member, the second connector of the at least one third support rests against the intersection and is unsecured to lower set of supports and the upper set of supports is unsupported except by the lower set of supports.

6. The combination of claim 5 wherein the second connector comprises a pair of perpendicular edges separated by a recess, the perpendicular edges abutting against the supports of the lower set of supports providing the intersection, the recess facing the junction of the intersection.

7. The combination of claim 1 wherein the upper set of supports is suspended from the overlying member and the second connector of the third supports are attached to the lower set of supports, the lower set of supports being unconnected to the overlying member except through the upper set of supports.

8. The combination of claim 1 wherein the upper set of supports is suspended from the overlying member and the lower set of supports is suspended from an overlying member and wherein at least one of the third supports is attached to the lower set of supports and abuts in an unconnected relation on the upper set of supports.

* * * * *